US011686200B2

(12) United States Patent
Moreno et al.

(10) Patent No.: US 11,686,200 B2
(45) Date of Patent: Jun. 27, 2023

(54) SLIDING VANE FLUID PUMP

(71) Applicant: DELPHI TECHNOLOGIES IP LIMITED, St. Michael (BB)

(72) Inventors: Alejandro Moreno, El Paso, TX (US); Aldo Venegas, Chihuahua (MX)

(73) Assignee: Delphi Technologies IP Limited, St. Michael (BB)

( * ) Notice: Subject to any disclaimer, the term of this patent is extended or adjusted under 35 U.S.C. 154(b) by 196 days.

(21) Appl. No.: 16/953,603

(22) Filed: Nov. 20, 2020

(65) Prior Publication Data

US 2022/0162943 A1 May 26, 2022

(51) Int. Cl.

| | |
|---|---|
| ***F04C 14/22*** | (2006.01) |
| ***F04C 2/344*** | (2006.01) |
| ***F01C 21/08*** | (2006.01) |
| ***F04C 18/344*** | (2006.01) |
| ***F04C 18/356*** | (2006.01) |
| ***F01C 3/04*** | (2006.01) |

(52) U.S. Cl.

CPC ..... *F01C 3/04* (2013.01); *F01C 21/0863* (2013.01); *F04C 2/344* (2013.01); *F04C 2210/203* (2013.01); *F04C 2240/10* (2013.01); *F04C 2240/30* (2013.01); *F04C 2240/40* (2013.01)

(58) Field of Classification Search

CPC ..... F04C 2/344; F04C 2/356; F04C 18/344; F04C 18/356; F04C 18/226; F04C 14/22; F01C 21/0836

See application file for complete search history.

(56) References Cited

U.S. PATENT DOCUMENTS

| | | | | |
|---|---|---|---|---|
| 3,213,803 | A * | 10/1965 | Meyer | F01C 21/0836 418/152 |
| 3,539,281 | A * | 11/1970 | Kramer | F01C 1/3442 418/125 |
| 4,538,974 | A | 9/1985 | Stich et al. | |
| 2007/0224067 | A1 | 9/2007 | Arnold et al. | |
| 2009/0196780 | A1 | 8/2009 | Shulver et al. | |
| 2009/0291000 | A1 | 11/2009 | Saga et al. | |
| 2011/0293458 | A1 | 12/2011 | Schmidt et al. | |
| 2015/0330388 | A1 | 11/2015 | Simoni et al. | |
| 2016/0138592 | A1 | 5/2016 | Moriglia et al. | |
| 2019/0338771 | A1 | 11/2019 | Bennett, Sr. et al. | |

FOREIGN PATENT DOCUMENTS

| | | | |
|---|---|---|---|
| CN | 2622431 | Y | 6/2004 |
| KR | 1020020067438 | A | 8/2002 |
| KR | 1020150071902 | A | 6/2015 |

* cited by examiner

*Primary Examiner* — Deming Wan
(74) *Attorney, Agent, or Firm* — Joshua M. Haines

(57) ABSTRACT

A fluid pump includes a rotor which is centered about an axis, the rotor having a rotor central chamber and a plurality of vane slots. A stator has a recess therein within which the rotor is located, the recess having a recess peripheral surface which is eccentric to the axis. Each vane slot includes a vane therein such that the vanes define a plurality of pumping chambers which expand and contract based on rotational position the rotor relative to the stator. A positioning ring is located within the rotor central chamber such that the positioning ring engages each vane and such that the positioning ring urges each vane into contact with the recess peripheral surface. The positioning ring is radially aligned with a midpoint of each vane.

11 Claims, 6 Drawing Sheets

SLIDING VANE FLUID PUMP

TECHNICAL FIELD OF INVENTION

The present disclosure relates to a fluid pump; more particularly to a sliding vane fluid pump; and even more particularly to a sliding vane fluid pump which includes a positioning ring which keeps a plurality of vanes of a rotor of the sliding vane fluid pump in radial contact with a stator of the sliding vane fluid pump.

BACKGROUND OF INVENTION

Many types of fluid pumps are well known for pressurizing and pumping a wide range of liquids. One type of fluid pump that is known is commonly referred to as a sliding vane fluid pump. In such sliding vane fluid pumps, a rotor is provided with a plurality of radially extending slots in an outer periphery thereof and within each slot is a vane. The rotor and vanes are received within an opening of a stator such that the opening is eccentric the rotor. The vanes engage the outer periphery of the opening of the stator and the rotor and vanes are sandwiched between an inlet plate and a pump section stator outlet plate such that pumping chambers are defined between each adjacent pair of vanes. Due to the eccentric nature of the opening in the stator, the pumping chambers expand and contract as the rotor is rotated. An inlet passage of the inlet plate is in communication with the pumping chambers at a rotational location where the pumping chambers are expanding and an outlet passage of the pump section stator outlet plate is in communication with the pumping chambers at a rotational location where the pumping chambers are contracting. In this way, rotation of the rotor causes the fluid to be drawn into the pumping chambers as they expand and subsequently pressurized and squeezed out as the pumping chambers contract. In order for proper operation, the vanes must maintain contact with the outer periphery of the opening of the stator. Due to the eccentric nature of the opening, the vanes must slide within their respective slots to maintain contact with the outer periphery of the opening of the stator. Centrifugal force provides some force to urge the vanes into contact with the outer periphery of the opening of the stator. However, hydraulic forces from the fluid being pumped tend to urge the vanes away from the outer periphery of the opening of the stator.

In order to ensure that the vanes maintain contact with the outer periphery of the opening of the stator, some sliding vane fluid pumps include push rods which act against opposing pairs of vanes. One such example is shown in KR Patent Application Publication No. KR20020067438 A. However, push rods can be difficult to assemble and are limited to sliding vane fluid pumps with four vanes because the push rods should act on the center of the vanes in order to prevent uneven loading on the vanes.

In an alternative arrangement, a pair of control rings may be provided instead of push rods. One control ring is located at one axial end of the vanes while the other control ring is located at the other axial end of the vanes. One such example is shown in US Patent Application Publication No. US 2019/0338771 A1. However, due to manufacturing variations, the control rings may provide uneven loading on the vanes which can have an undesirable effect on durability.

What is needed is a sliding vane fluid pump which minimizes or eliminates one or more of the shortcomings as set forth above.

SUMMARY OF THE INVENTION

Briefly described, a fluid pump includes a pump section rotor which is centered about an axis and which rotates about the axis, the pump section rotor having a pump section rotor central chamber and a plurality of vane slots arranged in a polar array centered about the axis such that each of the plurality of vane slots extend radially inward from an outer periphery of the pump section rotor and open into the pump section rotor central chamber; a pump section stator having a pump section stator recess therein within which the pump section rotor is located, the pump section stator recess having a pump section stator recess peripheral surface which is eccentric to the axis; a plurality of vanes which each extend in a direction parallel to the axis from a vane first end to a vane second end, each one of the plurality of vanes being received in a respective one of the plurality of vane slots such that each one of the plurality of vanes slides radially within its respective vane slot, the plurality of vanes defining a plurality of pumping chambers which expand and contract based on rotational position the pump section rotor relative to the pump section stator; and a positioning ring located within the pump section rotor central chamber such that the positioning ring engages each of the plurality of vanes and such that the positioning ring urges each of the plurality of vanes into contact with the pump section stator recess peripheral surface, wherein the positioning ring is radially aligned with a midpoint between the vane first end and the vane second end of each of the plurality of vanes. The fluid pump with positioning ring as describe herein ensures that the vanes maintain contact with the pump section stator recess peripheral surface and prevents uneven loading on the vanes, thereby ensuring smooth operation and long durability. Furthermore, the fluid pump is not limited to four vanes as in the case with such fluid pumps which incorporate push rods.

BRIEF DESCRIPTION OF DRAWINGS

This invention will be further described with reference to the accompanying drawings in which.

DETAILED DESCRIPTION OF INVENTION

Figure 1:
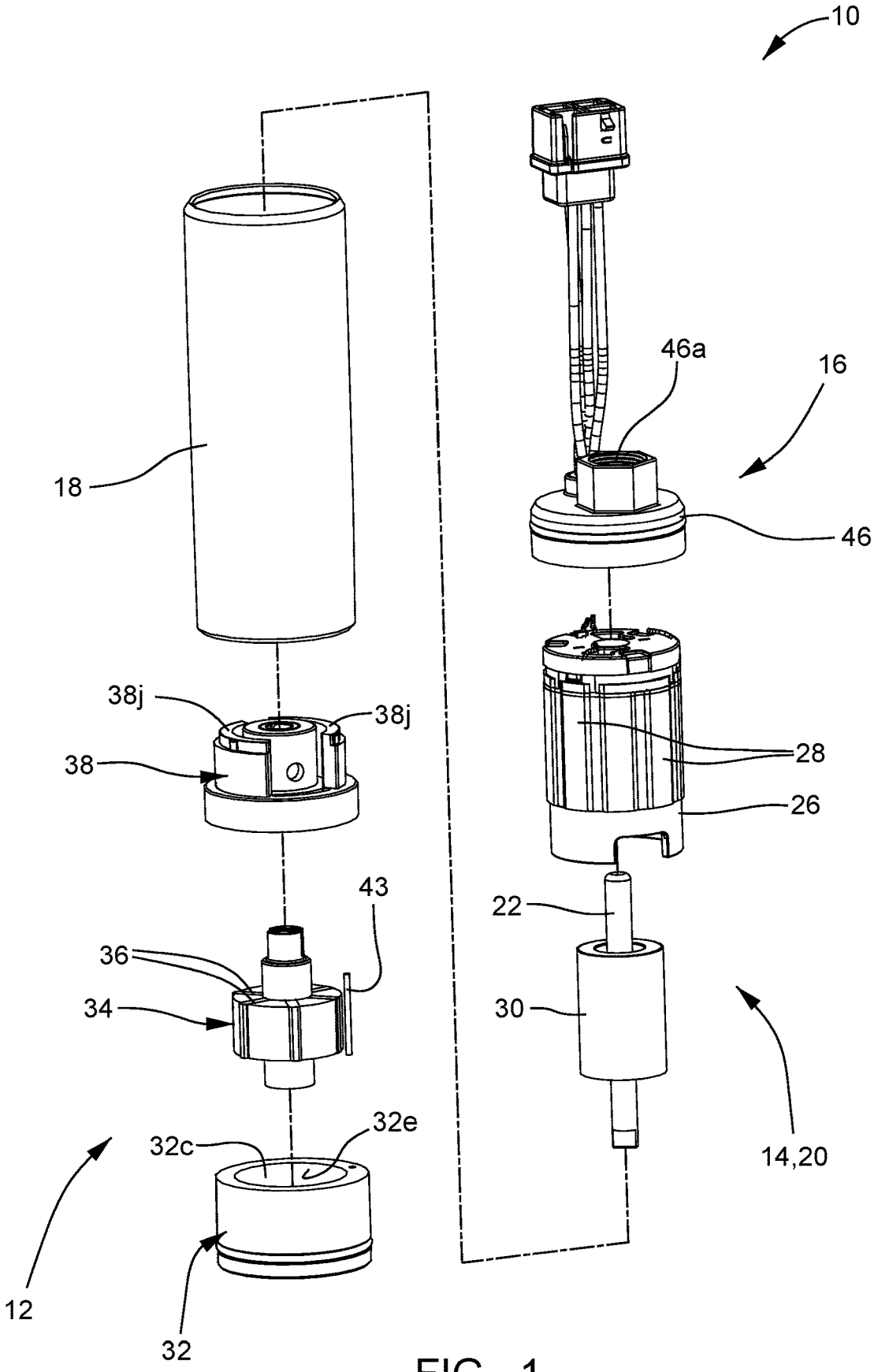
FIG. 1 is an exploded isometric view of a fluid pump in accordance with the present disclosure.
Figure 2:
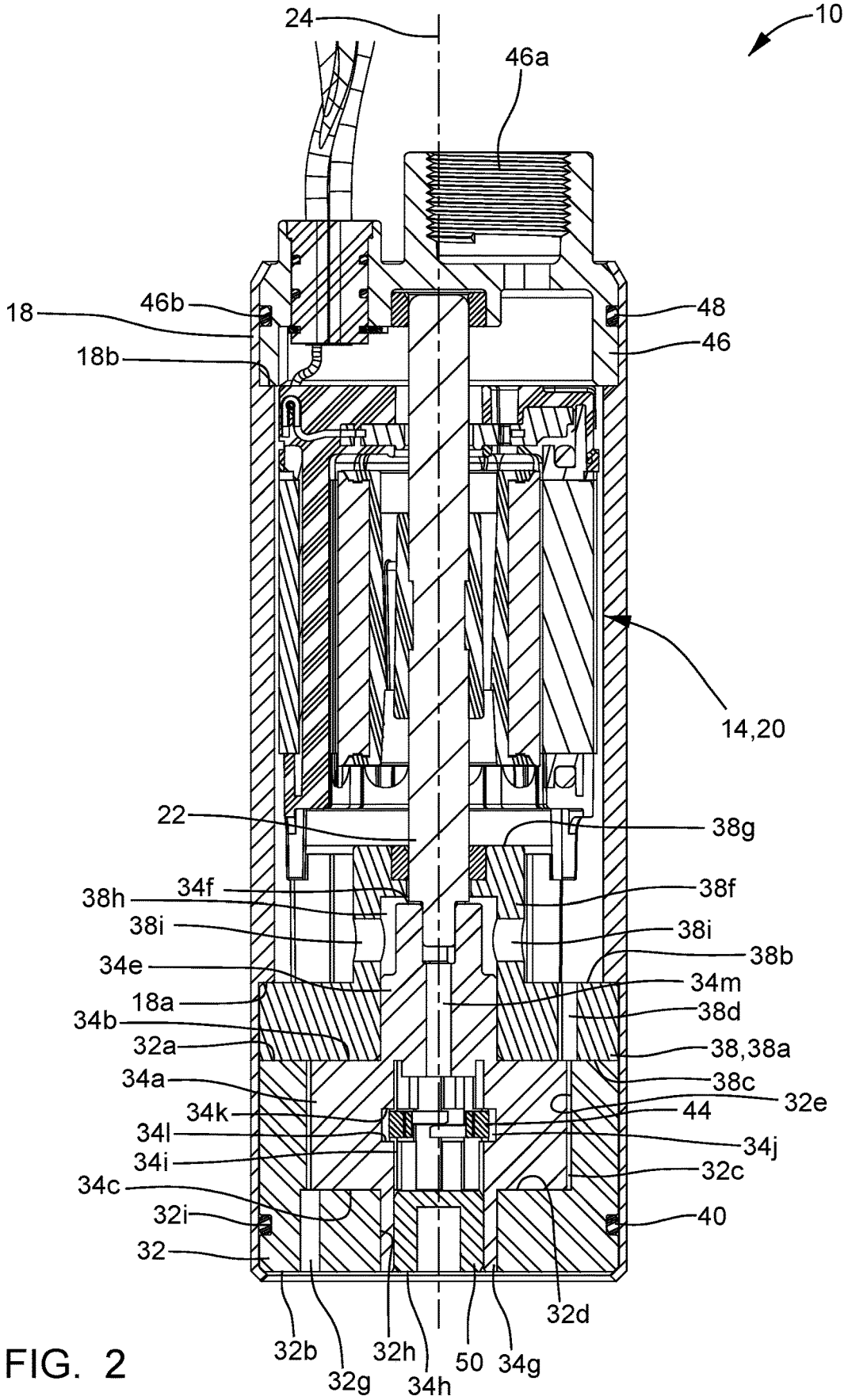
FIG. 2 is an axial cross-sectional view of the fluid pump in accordance with the present disclosure.

Reference will first be made to FIGS. 1 and 2 which are an exploded isometric view and an axial cross-sectional view respectively of a fluid pump illustrated as fuel pump 10 for pumping liquid fuel, for example gasoline or diesel fuel, from a fuel tank (not shown) to an internal combustion engine (not shown). The style of fuel pump 10 is what is known in the art as a sliding vane pump as will be well understood to a practitioner of ordinary skill in the art. While the fluid pump is illustrated as fuel pump 10, it should be understood that the invention is not to be limited to a fuel pump, but could also be applied to fluid pumps for pumping fluids other than fuel, for example, lubricating oil for the internal combustion engine. Fuel pump 10 generally includes a pump section 12 at one end, a motor section 14 adjacent to pump section 12, and an outlet section 16 adjacent to motor section 14 at the end of fuel pump 10 opposite pump section 12. A housing 18 of fuel pump 10 retains pump section 12, motor section 14 and outlet section 16 together. Fuel enters fuel pump 10 at pump section 12, a portion of which is rotated by motor section 14 as will be described in more detail later, and is pumped past motor section 14 to outlet section 16 where the fuel exits fuel pump 10.

Motor section 14 includes an electric motor 20 which is disposed within housing 18 which is hollow. Electric motor 20 includes a shaft 22 extending therefrom into pump section 12. Shaft 22 rotates about an axis 24 when an electric current is applied to electric motor 20. As embodied herein, electric motor 20 may be a brushless DC motor which includes a motor stator 26 having a plurality of motor windings 28. Electric motor 20 also includes a motor rotor 30 which is fixed to shaft 22 and which is permanently magnetized and includes regions of opposing polarity arranged in an alternating pattern around its circumference, i.e. around axis 24. Motor windings 28 are electrically commutated in order to work collectively with the alternating polarity of motor rotor 30, thereby causing motor rotor 30 and shaft 22 to rotate about axis 24. Electric motors are well known to those of ordinary skill in the art and consequently, electric motor 20 will not be described further herein. While electric motor 20 has been embodied herein as a brushless DC motor, it should be understood that electric motor 20 may take many forms and may be a brushed DC motor which is also well known to those of ordinary skill in the art.

With continued reference to FIGS. 1 and 2, pump section 12 includes a pump section stator 32, a pump section rotor 34 which supports a plurality of vanes 36, and a pump section stator outlet plate 38. It should be noted that only select vanes 36 have been labeled in the figures for clarity and the remaining vanes 36 should be readily apparent to a practitioner of ordinary skill in the art. Pump section stator 32 is disposed at the end of pump section 12 that is distal from motor section 14 while pump section stator outlet plate 38 is disposed at the end of pump section 12 that is proximal to motor section 14. Both pump section stator 32 and pump section stator outlet plate 38 are fixed relative to housing 18 in order to prevent relative movement between pump section stator 32 and pump section stator outlet plate 38 with respect to housing 18. This may be accomplished by crimping the axial ends of housing 18 to provide an axial clamping force on pump section stator 32 and pump section stator outlet plate 38.

Figure 3:
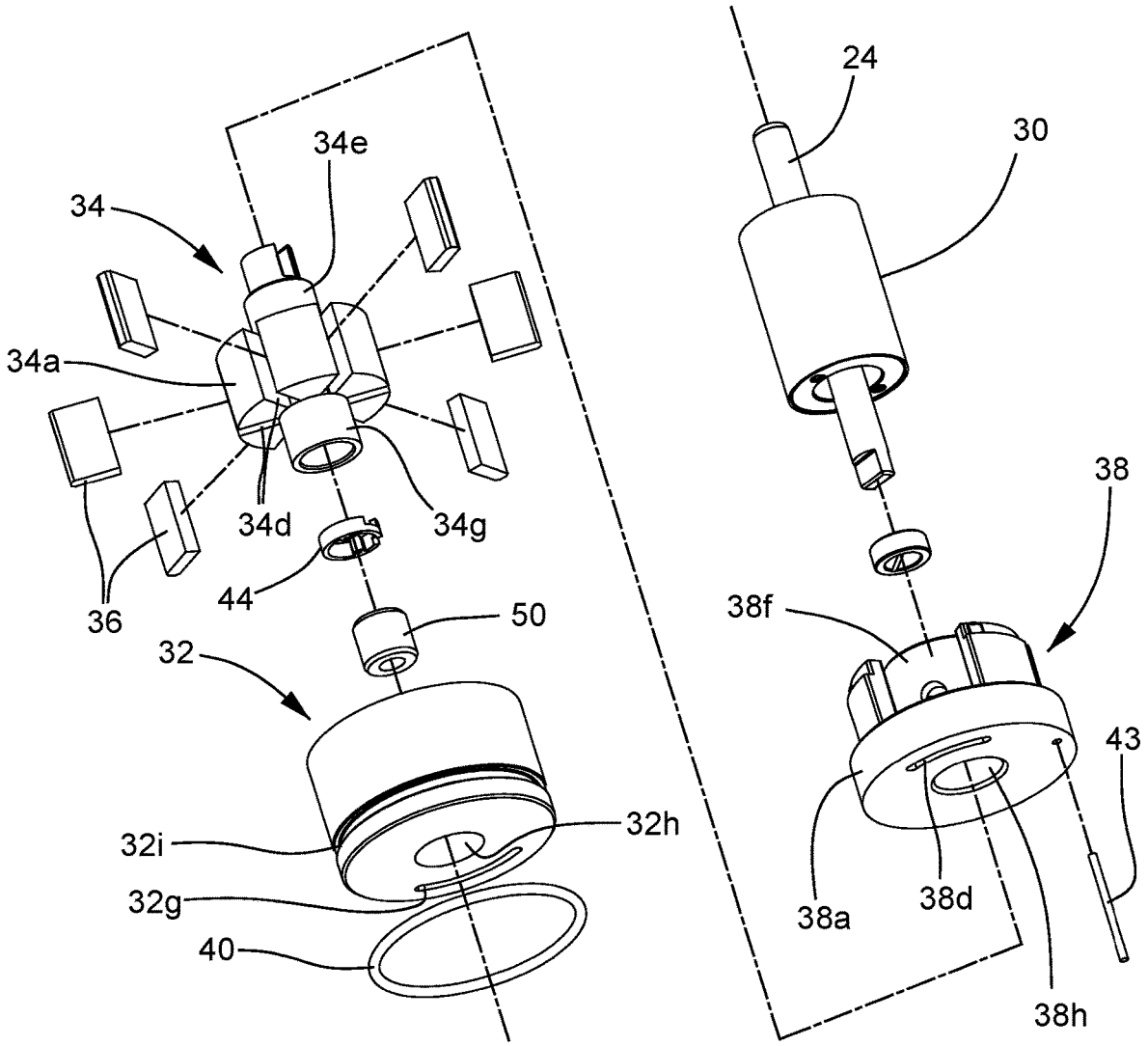
FIG. 3 is an exploded isometric view of a portion of the fluid pump in accordance with the present disclosure.
Figure 4:
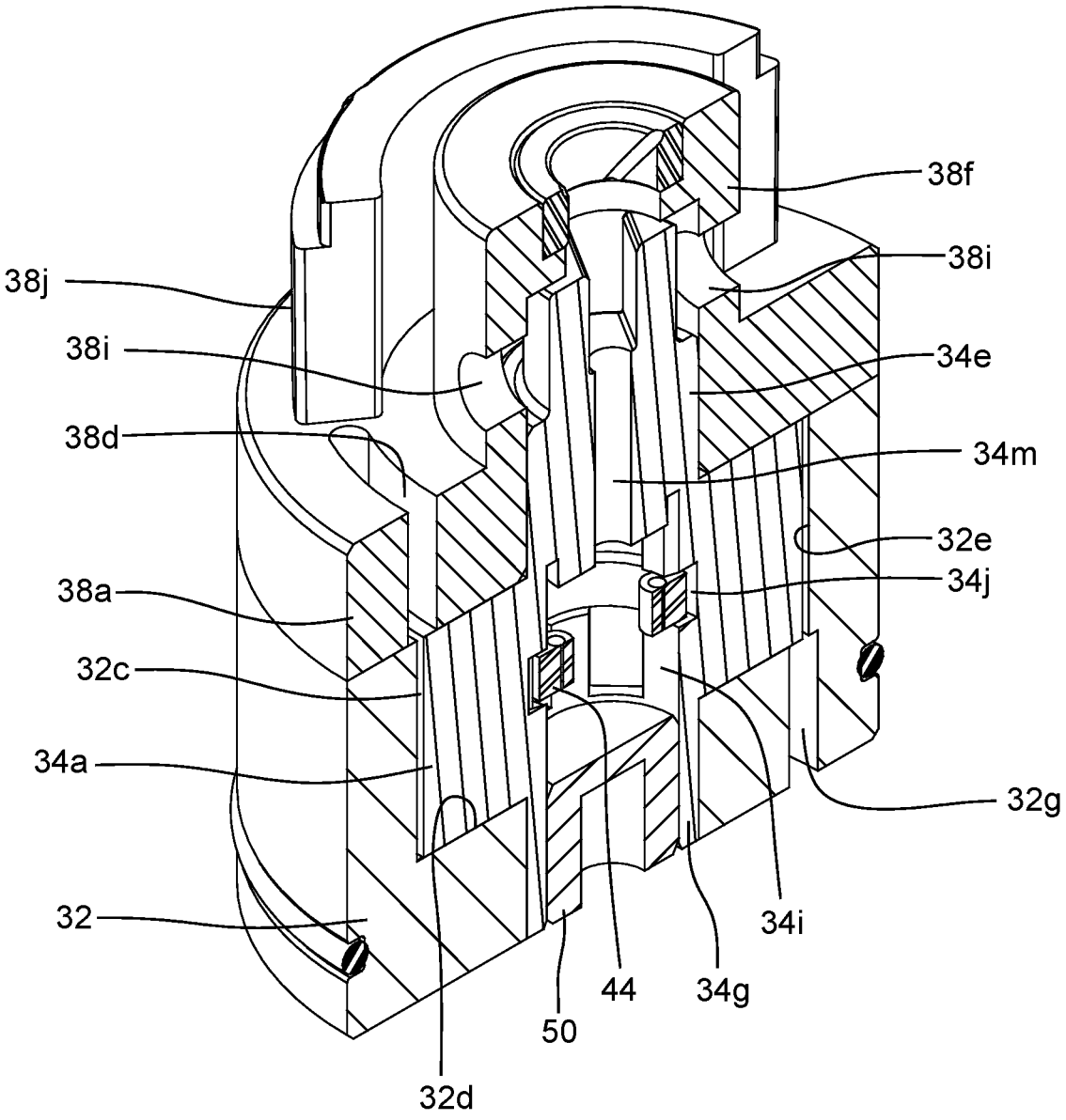
FIG. 4 is an isometric axial cross-sectional view of a pump section of the fluid pump in accordance with the present disclosure.
Figure 5:
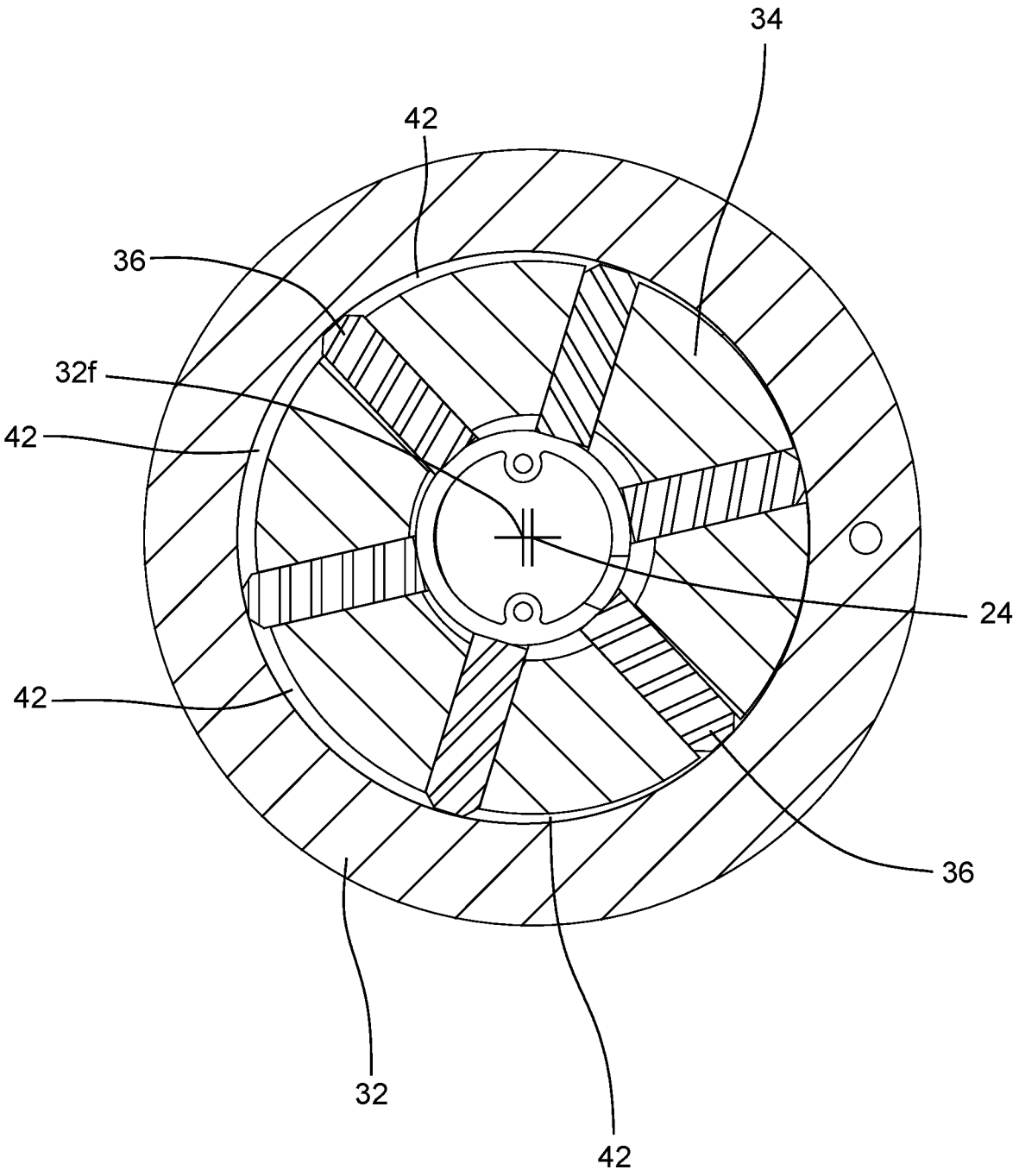
FIG. 5 is a radial cross-sectional view of the pump section of the fluid pump in accordance with the present disclosure.

With continued reference to FIGS. 1 and 2, and now with additional reference to FIGS. 3-5, pump section stator 32 is generally cylindrical in shape such that an outer periphery of pump section stator 32 is centered about, and extends along, axis 24 from a pump section stator upper end 32*a* to a pump section stator lower end 32*b*. Pump section stator 32 includes a pump section stator recess 32*c* extending axially thereinto from pump section stator upper end 32*a* such that pump section stator recess 32*c* terminates at a pump section stator recess floor 32*d* which is transverse to axis 24 and is preferably perpendicular to axis 24. Pump section stator recess 32*c* has a pump section stator recess peripheral surface 32*e* which is cylindrical in shape and which is centered about a pump section stator recess axis 32*f*. Pump section stator recess axis 32*f* is parallel to, and laterally offset from, axis 24, and in this way, pump section stator recess peripheral surface 32*e* is eccentric to axis 24.

Pump section stator 32 also includes a pump section stator fluid inlet 32*g* which extends from pump section stator lower end 32*b* to pump section stator recess 32*c*. As embodied herein, pump section stator fluid inlet 32*g* is arcuate in shape when sectioned in a direction perpendicular to pump section stator recess axis 32*f* and intersects with both pump section stator recess floor 32*d* and pump section stator recess peripheral surface 32*e*. Pump section stator fluid inlet 32*g* serves as an inlet for fuel to fuel pump 10 as will be described in greater detail later.

Pump section stator 32 also includes a pump section stator central through passage 32*h* which extends axially from pump section stator lower end 32*b* to pump section stator recess floor 32*d*. Pump section stator central through passage 32*h* is cylindrical and centered about axis 24. Consequently, pump section stator recess 32*c* is eccentric to pump section stator central through passage 32*h*.

Pump section stator 32 also includes a pump section stator seal groove 32*i* extending radially into the outer periphery of pump section stator 32. Pump section stator seal groove 32*i* is annular in shape and receives a seal, illustrated as first O-ring 40. First O-ring 40 is radially compressed between pump section stator 32 and housing 18, thereby sealing the radial interface between pump section stator 32 and housing 18 and preventing fuel from leaking therebetween.

Pump section rotor 34 includes a pump section rotor central portion 34*a* which is cylindrical and centered about axis 24 and which extends axially along axis 24 from a pump section rotor central portion upper end 34*b* to a pump section rotor central portion lower end 34*c*. Pump section rotor central portion 34*a* is located entirely within pump section stator recess 32*c* such that pump section rotor central portion lower end 34*c* faces toward pump section stator recess floor 32*d*. A plurality of vane slots 34*d* extend radially inward from the outer periphery of pump section rotor central portion 34*a* and are arranged in a polar array centered about axis 24. It should be noted that only select vanes slots 34*d* have been labeled in the figures for clarity while the remaining vanes slots 34*d* should be readily apparent to a practitioner of ordinary skill in the art. One vane slot 34*d* is provided for each vane 36 and each vane slot 34*d* has a width which provides a close sliding interface with vane 36. In this way, each vane 36 is able to slide radially within its respective vane slot 34*d* during operation while substantially preventing fuel from leaking past vane 36.

Pump section rotor 34 also includes a pump section rotor upper portion 34*e* which is cylindrical and centered about axis 24 and which extends axially along axis 24 from pump section rotor central portion upper end 34*b* to a pump section rotor upper portion upper end 34*f*. Pump section rotor upper portion 34*e* is smaller in diameter than pump section rotor central portion 34*a*. Furthermore, pump section rotor upper portion 34*e* may have a stepped outer periphery as shown. Pump section rotor upper portion 34*e* provides radial support and guidance for pump section rotor 34 as will be made more clear later. Shaft 22 is rotationally coupled to pump section rotor upper portion 34*e*, for example with complementary mating features which are illustrated as a slot in pump section rotor upper portion 34*e* which mates with complementary flats of shaft 22. However, any known arrangement for providing rotational coupling can be provided as an alternative.

Pump section rotor 34 also includes a pump section rotor lower portion 34*g* which is cylindrical and centered about axis 24 and which extends axially along axis 24 from pump section rotor central portion lower end 34*c* to a pump section rotor lower portion lower end 34*h*. Pump section rotor lower portion 34*g* is smaller in diameter than pump section rotor central portion 34*a* and is sized to fit within pump section stator central through passage 32*h* in a close sliding interface such that pump section rotor lower portion 34*g* freely rotates within pump section stator central through passage 32*h* while substantially preventing fuel from passing therethrough. In this way, pump section rotor lower portion 34*g* also radially supports and guides pump section rotor 34 as in a journal bearing interface.

A pump section rotor central chamber 34*i* extends axially into pump section rotor 34 at pump section rotor lower portion lower end 34*h* and extends into pump section rotor central portion 34*a*. Pump section rotor central chamber 34*i* is cylindrical and centered about axis 24 and includes a pump section rotor central chamber groove 34*j* which is annular in shape and extends radially outward, thereby defining a groove upper surface 34*k* and a groove lower surface 34*l*. It is important to note that each vane slot 34*d* opens into pump section rotor central chamber groove 34*j*, the importance of which will be understood later. A pump section rotor high-pressure passage 34*m* may extend from pump section rotor central chamber 34*i* into pump section rotor upper portion 34*e* as will be described in greater detail later.

Pump section stator outlet plate 38 includes a pump section stator outlet plate lower portion 38*a* which is cylindrical and centered about axis 24 and which extends axially along axis 24 from and pump section stator outlet plate lower portion upper end 38*b* to a pump section stator outlet plate lower portion lower end 38*c* which mates with pump section stator upper end 32*a*. Pump section stator outlet plate lower portion 38*a* is captured axially between, and axially engages, a housing lower shoulder 18*a* of housing 18 and pump section stator upper end 32*a*. Furthermore, pump section rotor central portion 34*a* and vanes 36 are captured axially between pump section stator outlet plate lower portion lower end 38*c* and pump section stator recess floor 32*d*. In this way, a plurality of pumping chambers 42 are defined by vanes 36 such that each pumping chamber 42 is defined by adjacent vanes 36, radially between pump section rotor central portion 34*a* and pump section stator recess peripheral surface 32*e* and axially between pump section stator outlet plate lower portion lower end 38*c* and pump section stator recess floor 32*d*. Since pump section stator recess 32*c* is eccentric to axis 24, about which pump section rotor 34 rotates, each pumping chamber 42 expands and contracts as pump section rotor 34 rotates. Pump section stator fluid inlet 32*g* is connected to one or more pumping chambers 42 that are expanding, thereby drawing fuel thereinto. It should be noted that only select pumping chambers 42 are labeled in the figures and the remaining pumping chambers 42 would be readily apparent to a practitioner of ordinary skill in the art.

A pump section stator outlet plate fluid outlet 38*d* extends from pump section stator outlet plate lower portion upper end 38*b* to pump section stator outlet plate lower portion lower end 38*c*. As embodied herein, pump section stator outlet plate fluid outlet 38*d* is arcuate in shape when sectioned in a direction perpendicular to pump section stator recess axis 32*f*. Pump section stator outlet plate fluid outlet 38*d* serves as an outlet for pump section 12 for fluid that has been pressurized in pumping chambers 42. An alignment pin 43 is provided to ensure proper circumferential orientation about axis 24 between pump section stator 32 and pump section stator outlet plate 38, and more specifically between pump section stator fluid inlet 32*g* and pump section stator outlet plate fluid outlet 38*d*. Alignment pin 43 is received within complementary apertures extending into pump section stator upper end 32*a* and pump section stator outlet plate lower portion lower end 38*c*, thereby ensuring proper circumferential orientation about axis 24 between pump section stator 32 and pump section stator outlet plate 38.

Pump section stator outlet plate 38 also includes a pump section stator outlet plate upper portion 38*f* which is cylindrical and centered about axis 24 and which extends axially along axis 24 from pump section stator outlet plate lower portion upper end 38*b* a pump section stator outlet plate upper portion upper end 38*g*. As can be seen in the figures, pump section stator outlet plate upper portion 38*f* is smaller in diameter than pump section stator outlet plate lower portion 38*a*. A pump section stator outlet plate central bore 38*h* extends axially through pump section stator outlet plate 38 from pump section stator outlet plate lower portion lower end 38*c* to pump section stator outlet plate upper portion upper end 38*g* such that pump section stator outlet plate central bore 38*h* is centered about axis 24. Pump section stator outlet plate central bore 38*h* is sized to receive pump section rotor upper portion 34*e* in a close sliding interface such that pump section rotor upper portion 34*e* freely rotates within pump section stator outlet plate central bore 38*h* while substantially preventing fuel from passing through the interface. In this way, pump section stator outlet plate 38 also radially supports and guides pump section rotor 34 as in a journal bearing interface. Pump section stator outlet plate central bore 38*h* also accommodates shaft 22 in order to allow connection between shaft 22 and pump section rotor 34, and furthermore, a bearing insert may be provided in pump section stator outlet plate central bore 38*h* as shown in the figures in order to provide radial support to the lower end of shaft 22 as in a journal bearing interface.

One or more pump section stator outlet plate high-pressure passages 38*i* may be provided to extend radially from the outer periphery of pump section stator outlet plate upper portion 38*f* to pump section stator outlet plate central bore 38*h* such that pump section stator outlet plate high-pressure passages 38*i* are in fluid communication with pump section rotor high-pressure passage 34*m*. In this way, high-pressure fuel is provided to pump section rotor central chamber 34*i* in order to assist in keeping vanes 36 pressed against pump section stator recess peripheral surface 32*e*, thereby aiding in sealing between adjacent pumping chambers 42.

A positioning ring 44 is provided within pump section rotor central chamber groove 34*j* in order to ensure that vanes 36 are properly positioned and pressed against pump section stator recess peripheral surface 32*e* during operation. Positioning ring 44 will be described in greater detail later.

In order to provide a base to support the lower end of motor stator 26, pump section stator outlet plate 38 includes a pair of pump section stator outlet plate support extensions 38*j* which extend from pump section stator outlet plate lower portion upper end 38*b*. As can be seen in the figures, pump section stator outlet plate support extensions 38*j* are each arcuate in shape and are spaced radially outward from pump section stator outlet plate upper portion 38*f* such that corresponding arcuate shaped spaces are formed between radially between each pump section stator outlet plate support extension 38*j* and pump section stator outlet plate upper portion 38*f*.

Outlet section 16 includes an end cap 46 which closes the end of housing 18 which is opposite pump section 12. End cap 46 is generally cylindrical in shape such that an outer periphery of end cap 46 is centered about, and extends along, axis 24. End cap 46 is axially positioned within housing 18 by abutting a housing upper shoulder 18*b*, thereby establishing the extent to which end cap 46 is inserted into housing 18 toward motor section 14. End cap 46 includes an end cap fluid outlet 46*a* which extends through end cap 46, thereby providing an outlet for pressurized fuel to pass out of fuel pump 10. End cap fluid outlet 46*a* is configured to be coupled to a conduit which extends to, for example, the internal combustion engine. While end cap fluid outlet 46*a* has been illustrated in the figures as a threaded female connection, it should be understood that any of numerous well-known connection arrangements may be used in the alternative. End cap 46 also includes an end cap seal groove 46*b* extending radially in the outer periphery thereof. End cap seal groove 46*b* is annular in shape and receives a seal, illustrated as second O-ring 48. Second O-ring 48 is radially compressed between end cap 46 and housing 18, thereby sealing the radial interface between end cap 46 and housing 18 and preventing fuel from leaking therebetween.

In addition to providing an outlet for pressurized fuel, end cap 46 also provides radial support to the upper end of shaft 22 as in a journal bearing interface. This may be accomplished through a bearing insert as illustrated in the figures. Furthermore, end cap 46 also provides a passage for wiring to enter fuel pump 10, the wiring being used to operate electric motor 20.

Figure 6:
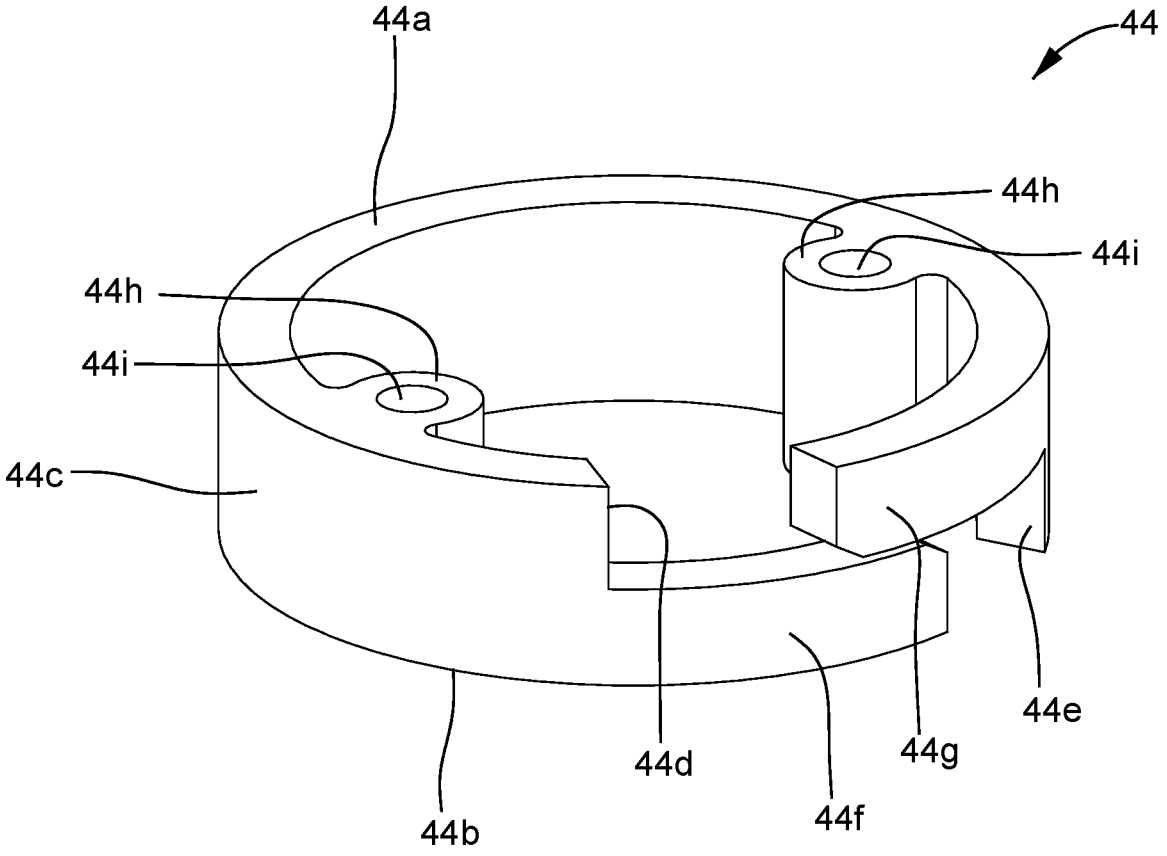
FIG. 6 is an isometric view of a positioning ring of the fluid pump in accordance with the present disclosure.

With continued reference to FIGS. 1-5, and now with additional reference to FIG. 6, positioning ring 44 will now be described in greater. Positioning ring 44 extends axially from a positioning ring upper end 44*a* to a positioning ring lower end 44*b*. Positioning ring upper end 44*a* faces toward groove upper surface 34*k* while positioning ring lower end 44*b* faces toward groove lower surface 34*l*. A positioning ring main section 44*c* extends around a portion of the circumference of positioning ring 44 from a positioning ring main portion first end wall 44*d* to a positioning ring main portion second end wall 44*e*. By way of non-limiting example only, positioning ring main section 44*c* extends about 275° around the circumference of positioning ring 44. A positioning ring lower overlapping portion 44*f* extends from positioning ring main portion first end wall 44*d* toward positioning ring main portion second end wall 44*e*. Positioning ring lower overlapping portion 44*f* extends about 55° around the circumference of positioning ring 44, and as a result, there remains a gap of about 30° between positioning ring lower overlapping portion 44*f* and positioning ring main portion second end wall 44*e*. Positioning ring lower overlapping portion 44*f* extends axially, i.e. a direction parallel to axis 24, from positioning ring lower end 44*b* for a distance that is slightly less than half of the distance from positioning ring lower end 44*b* to positioning ring upper end 44*a*. A positioning ring upper overlapping portion 44*g* extends from positioning ring main portion second end wall 44*e* toward positioning ring main portion first end wall 44*d*. Positioning ring upper overlapping portion 44*g* extends about 55° around the circumference of positioning ring 44, and as a result, there remains a gap of about 30° between positioning ring upper overlapping portion 44*g* and positioning ring main portion first end wall 44*d*. Positioning ring upper overlapping portion 44*g* extends axially, i.e. a direction parallel to axis 24, from positioning ring upper end 44*a* for a distance that is slightly less than half of the distance from positioning ring upper end 44*a* to positioning ring lower end 44*b*. In this way, positioning ring lower overlapping portion 44*f* and positioning ring upper overlapping portion 44*g* are axially aligned for about 25° of the perimeter of positioning ring 44, thereby ensuring there is 360° degrees in continuity of the perimeter of positioning ring 44 while allowing positioning ring 44 to be elastically contracted in order to be installed within pump section rotor central chamber groove 34*j*. As a result of this 360° degrees in continuity of the perimeter of positioning ring 44, the rotational position of positioning ring 44 does not alter its ability to interact with each vane 36. Positioning ring 44 is made of a compliant and resilient material, for example spring steel, which allows positioning ring 44 to be elastically deformed to decrease its outer diameter, thereby allowing for installation as will be described in greater detail later. It should be noted that the angular values included in the preceding description are provided with positioning ring 44 in a free state, i.e. with no forces applied thereto which would cause elastic deformation in the radial direction.

In order to assist in installing positioning ring 44, positioning ring 44 may include installation tabs 44*h* which each extend radially inward from diametrically opposed locations on positioning ring main section 44*c*. Each installation tab 44*h* includes an installation tab aperture 44*i* which allows a tool (not shown), such as snap ring pliers, to engage therewith to elastically deform positioning ring 44 to fit within the pump section rotor central chamber 34*i* at pump section rotor lower portion lower end 34*h*. Positioning ring 44 can then be slid upward until it is aligned with pump section rotor central chamber groove 34*j*, thereby allowing positioning ring 44 to expand outward to engage vanes 36. When positioning ring 44 expands outward in pump section rotor central chamber groove 34*j*, a portion of positioning ring 44 is captured axially between groove upper surface 34*k* and groove lower surface 34*l* which maintains the axial position of positioning ring 44. In its free state, the outside diameter of positioning ring 44 is sized with respect to the diameter of pump section rotor central chamber groove 34*j* to allow positioning ring 44 to move therein in an orbital pattern as vanes 36 slide radially within vane slots 34*d* as a result of rotation of pump section rotor 34 during operation. Positioning ring 44 is aligned with a midpoint between an upper end of said vanes 36 and a lower end of said vanes 36, thereby preventing a tipping force from being applied to vanes 36. After positioning ring 44 is installed, a sealing plug 50 is installed within pump section rotor central chamber 34*i* at pump section rotor lower portion lower end 34*h* in order to prevent pressurized fuel from leaking therefrom.

While positioning ring 44 has been embodied herein as having 360° degrees in continuity of the perimeter of positioning ring 44, it should be understood that it is possible for positioning ring 44 to have a discontinuity. For example, a C-ring could be substituted, however, it may be necessary to fix the orientation of the C-ring in order to ensure that one of vanes 36 cannot be aligned with the discontinuity in the perimeter of the C-ring. This may also limit the number of vanes that can be included.

While the fluid pump has been illustrated herein as fuel pump 10 which is a self-contained unit which includes electric motor 20, it should be understood that other means to provide rotation to pump section rotor 34 may alternatively be used. By way of non-limiting example only, the fluid pump may be a pump for pumping lubricant in an internal combustion engine. In such an example, pump section rotor 34 may be driven by a shaft from the internal combustion engine. As a result, the electric motor may be omitted.

The fluid pump, embodied herein as fuel pump 10, which includes positioning ring 44 that is radially aligned with the axial midpoint of vanes 36, ensures that vanes 36 maintain contact with pump section stator recess peripheral surface 32*e*. Furthermore, since positioning ring 44 is radially aligned with the axial midpoint of vanes 36, uneven loading on vanes 36 is prevented, thereby ensuring smooth operation and long durability. Also furthermore, the fluid pump is not limited to four vanes as is the case with such fluid pumps which incorporate push rods.

While this invention has been described in terms of preferred embodiments thereof, it is not intended to be so limited, but rather only to the extent set forth in the claims that follow.

We claim:

1. A fluid pump comprising:

a pump section rotor which is centered about an axis and which rotates about said axis, said pump section rotor having a pump section rotor central chamber and a plurality of vane slots arranged in a polar array centered about said axis such that each of said plurality of vane slots extend radially inward from an outer periphery of said pump section rotor and open into said pump section rotor central chamber;

a pump section stator having a pump section stator recess therein within which said pump section rotor is located, said pump section stator recess having a pump section stator recess peripheral surface which is eccentric to said axis;

a plurality of vanes which each extend in a direction parallel to said axis from a vane first end to a vane second end, each one of said plurality of vanes being received in a respective one of said plurality of vane slots such that each one of said plurality of vanes slides radially within its respective vane slot, said plurality of vanes defining a plurality of pumping chambers which expand and contract based on rotational position said pump section rotor relative to said pump section stator; and a positioning ring located within said pump section rotor central chamber such that said positioning ring engages each of said plurality of vanes and such that said positioning ring urges each of said plurality of vanes into contact with said pump section stator recess peripheral surface, wherein said positioning ring is radially aligned with a midpoint between said vane first end and said vane second end of each of said plurality of vanes, and wherein said positioning ring is configured to move in an orbital pattern as said plurality of vanes slide within said plurality of vane slots as a result of rotation of said pump section rotor.

2. A fluid pump as in claim 1, wherein said pump section rotor central chamber includes a pump section rotor central chamber groove which is annular in shape and extends radially outward, thereby defining a groove upper surface and a groove lower surface such that said positioning ring is captured axially between said groove upper surface and said groove lower surface.

3. A fluid pump as in claim 1, wherein:

said pump section stator extends axially from a pump section stator upper end to a pump section stator lower end such that said pump section stator recess extends into said pump section stator from said pump section stator upper end and terminates at a pump section stator recess floor which is transverse to said axis, wherein a pump section stator central through passage extends from said pump section stator recess floor to said pump section stator lower end;

said pump section rotor includes a pump section rotor central portion which extends axially from a pump section rotor central portion upper end to a pump section rotor central portion lower end and which includes said plurality of vane slots;

said pump section rotor also includes a pump section rotor lower portion which extends axially from said pump section rotor central portion lower end to a pump section rotor lower portion lower end; and said pump section rotor lower portion fits within said pump section stator central through passage in a close sliding interface.

4. A fluid pump comprising:

a pump section rotor which is centered about an axis and which rotates about said axis, said pump section rotor having a pump section rotor central chamber and a plurality of vane slots arranged in a polar array centered about said axis such that each of said plurality of vane slots extend radially inward from an outer periphery of said pump section rotor and open into said pump section rotor central chamber;

a pump section stator having a pump section stator recess therein within which said pump section rotor is located, said pump section stator recess having a pump section stator recess peripheral surface which is eccentric to said axis;

a plurality of vanes which each extend in a direction parallel to said axis from a vane first end to a vane second end, each one of said plurality of vanes being received in a respective one of said plurality of vane slots such that each one of said plurality of vanes slides radially within its respective vane slot, said plurality of vanes defining a plurality of pumping chambers which expand and contract based on rotational position said pump section rotor relative to said pump section stator; and a positioning ring located within said pump section rotor central chamber such that said positioning ring engages each of said plurality of vanes and such that said positioning ring urges each of said plurality of vanes into contact with said pump section stator recess peripheral surface, wherein said positioning ring is radially aligned with a midpoint between said vane first end and said vane second end of each of said plurality of vanes;

wherein said pump section stator extends axially from a pump section stator upper end to a pump section stator lower end such that said pump section stator recess extends into said pump section stator from said pump section stator upper end and terminates at a pump section stator recess floor which is transverse to said axis, wherein a pump section stator central through passage extends from said pump section stator recess floor to said pump section stator lower end;

wherein said pump section rotor includes a pump section rotor central portion which extends axially from a pump section rotor central portion upper end to a pump section rotor central portion lower end and which includes said plurality of vane slots;

wherein said pump section rotor also includes a pump section rotor lower portion which extends axially from said pump section rotor central portion lower end to a pump section rotor lower portion lower end;

wherein said pump section rotor lower portion fits within said pump section stator central through passage in a close sliding interface; and wherein said pump section stator includes a pump section stator fluid inlet which extends from said pump section stator lower end to said pump section stator recess floor to one of said plurality of pumping chambers which is expanding.

5. A fluid pump as in claim 4, wherein said pump section rotor central chamber includes a pump section rotor central chamber groove which is annular in shape and extends radially outward, thereby defining a groove upper surface and a groove lower surface such that said positioning ring is captured axially between said groove upper surface and said groove lower surface.

6. A fluid pump comprising:

a pump section rotor which is centered about an axis and which rotates about said axis, said pump section rotor having a pump section rotor central chamber and a plurality of vane slots arranged in a polar array centered about said axis such that each of said plurality of vane slots extend radially inward from an outer periphery of said pump section rotor and open into said pump section rotor central chamber;

a pump section stator having a pump section stator recess therein within which said pump section rotor is located, said pump section stator recess having a pump section stator recess peripheral surface which is eccentric to said axis;

a plurality of vanes which each extend in a direction parallel to said axis from a vane first end to a vane second end, each one of said plurality of vanes being received in a respective one of said plurality of vane slots such that each one of said plurality of vanes slides radially within its respective vane slot, said plurality of vanes defining a plurality of pumping chambers which expand and contract based on rotational position said pump section rotor relative to said pump section stator; and a positioning ring located within said pump section rotor central chamber such that said positioning ring engages each of said plurality of vanes and such that said positioning ring urges each of said plurality of vanes into contact with said pump section stator recess peripheral surface, wherein said positioning ring is radially aligned with a midpoint between said vane first end and said vane second end of each of said plurality of vanes;

wherein said pump section stator extends axially from a pump section stator upper end to a pump section stator lower end such that said pump section stator recess extends into said pump section stator from said pump section stator upper end and terminates at a pump section stator recess floor which is transverse to said axis, wherein a pump section stator central through passage extends from said pump section stator recess floor to said pump section stator lower end;

wherein said pump section rotor includes a pump section rotor central portion which extends axially from a pump section rotor central portion upper end to a pump section rotor central portion lower end and which includes said plurality of vane slots;

wherein said pump section rotor also includes a pump section rotor lower portion which extends axially from said pump section rotor central portion lower end to a pump section rotor lower portion lower end;

wherein said pump section rotor lower portion fits within said pump section stator central through passage in a close sliding interface;

wherein said pump section rotor also includes a pump section rotor upper portion which extends axially from said pump section rotor central portion upper end to a pump section rotor upper portion upper end;

wherein said fluid pump further comprises a pump section stator outlet plate which includes a pump section stator outlet plate lower portion and a pump section stator outlet plate upper portion;

wherein said pump section stator outlet plate lower portion extends from a pump section stator outlet plate lower portion lower end, which mates with said pump section stator upper end, to a pump section stator outlet plate lower portion upper end;

wherein said pump section stator outlet plate upper portion extends axially away from said pump section stator outlet plate lower portion to a pump section stator outlet plate upper portion upper end; and wherein said pump section stator outlet plate includes a pump section stator outlet plate central bore such that said pump section rotor upper portion fits within said pump section stator outlet plate central bore in a close sliding interface.

7. A fluid pump as in claim 6, wherein said pump section rotor central chamber includes a pump section rotor central chamber groove which is annular in shape and extends radially outward, thereby defining a groove upper surface and a groove lower surface such that said positioning ring is captured axially between said groove upper surface and said groove lower surface.

8. A fluid pump as in claim 7, wherein:

said pump section rotor central chamber extends to said pump section rotor lower portion lower end; and said positioning ring is configured to be elastically radially compressed to fit within said pump section rotor central chamber at said pump section rotor lower portion lower end and expand radially outward when aligned with said pump section rotor central chamber groove.

9. A fluid pump as in claim 7, wherein said fluid pump further comprises:

an electric motor which is coupled to and rotates said pump section rotor;

a housing within which said electric motor, said pump section stator, and said pump section rotor are located such that said housing retains said electric motor, said pump section stator, and said pump section rotor together.

10. A fluid pump as in claim 6, wherein said pump section stator outlet plate includes a pump section stator outlet plate fluid outlet which extends from said pump section stator outlet plate lower portion lower end to said pump section stator outlet plate lower portion upper end to one of said plurality of pumping chambers which is contracting.

11. A fluid pump comprising:

a pump section rotor which is centered about an axis and which rotates about said axis, said pump section rotor having a pump section rotor central chamber and a plurality of vane slots arranged in a polar array centered about said axis such that each of said plurality of vane slots extend radially inward from an outer periphery of said pump section rotor and open into said pump section rotor central chamber;

a pump section stator having a pump section stator recess therein within which said pump section rotor is located, said pump section stator recess having a pump section stator recess peripheral surface which is eccentric to said axis;

a plurality of vanes which each extend in a direction parallel to said axis from a vane first end to a vane second end, each one of said plurality of vanes being received in a respective one of said plurality of vane slots such that each one of said plurality of vanes slides radially within its respective vane slot, said plurality of vanes defining a plurality of pumping chambers which expand and contract based on rotational position said pump section rotor relative to said pump section stator; and a positioning ring located within said pump section rotor central chamber such that said positioning ring engages each of said plurality of vanes and such that said positioning ring urges each of said plurality of vanes into contact with said pump section stator recess peripheral surface, wherein said positioning ring is radially aligned with a midpoint between said vane first end and said vane second end of each of said plurality of vanes;

wherein said pump section stator extends axially from a pump section stator upper end to a pump section stator lower end such that said pump section stator recess extends into said pump section stator from said pump section stator upper end and terminates at a pump section stator recess floor which is transverse to said axis, wherein a pump section stator central through passage extends from said pump section stator recess floor to said pump section stator lower end;

wherein said pump section rotor includes a pump section rotor central portion which extends axially from a pump section rotor central portion upper end to a pump section rotor central portion lower end and which includes said plurality of vane slots;

wherein said pump section rotor also includes a pump section rotor lower portion which extends axially from said pump section rotor central portion lower end to a pump section rotor lower portion lower end;

wherein said pump section rotor lower portion fits within said pump section stator central through passage in a close sliding interface;

wherein said pump section rotor central chamber extends to said pump section rotor lower portion lower end; and wherein said fluid pump further comprise a sealing plug within said pump section rotor central chamber at said pump section rotor lower portion lower end which prevents fuel from passing out of said pump section rotor central chamber at said pump section rotor lower portion lower end.

* * * * *